US005413198A

United States Patent [19]

Ferris

[11] Patent Number: 5,413,198

[45] Date of Patent: May 9, 1995

[54] FLEXIBLE GARMENT AND ACCESSORY CASE HAVING A DETACHABLE BRIEFCASE

[76] Inventor: Jack E. Ferris, 301 SE. Complex (CCX), Wahpeton, N. Dak. 58075

[21] Appl. No.: 119,626

[22] Filed: Sep. 13, 1993

[51] Int. Cl.[6] ..... A45C 3/02; A45C 7/00; A45C 13/10

[52] U.S. Cl. ..... 190/1; 190/107; 190/108; 190/110; 206/287.1; 383/4

[58] Field of Search ..... 190/103-105, 190/107-112, 903, 1; 383/4; 206/287, 287.1

[56] References Cited

U.S. PATENT DOCUMENTS

| | | | |
|---|---|---|---|
| 767,898 | 8/1904 | Lamphier | 190/107 |
| 1,666,878 | 4/1928 | Johnson | 190/900 X |
| 2,154,630 | 4/1939 | Marbury et al. | 190/111 |
| 2,442,105 | 5/1948 | Vacheron | 383/4 X |
| 2,496,128 | 1/1950 | Lifton | 190/111 |
| 2,536,169 | 1/1951 | Gray | 190/103 |
| 3,041,638 | 7/1962 | Lo Vico | 190/901 X |
| 3,143,748 | 8/1964 | Manning | 190/1 X |
| 3,175,658 | 3/1965 | Bierman | 190/111 X |
| 3,291,266 | 12/1966 | Komroff | 190/113 X |
| 4,081,061 | 3/1978 | Tucker | 190/108 |
| 4,423,834 | 1/1984 | Rush | 190/901 X |
| 4,436,189 | 3/1984 | Baum | 190/108 |
| 4,483,427 | 11/1984 | Gerch | 190/112 X |
| 4,694,940 | 9/1987 | Horiuchi | 190/109 |
| 4,723,300 | 2/1988 | Aranow | 190/1 X |
| 4,898,274 | 2/1990 | Stout et al. | 190/111 X |
| 4,951,816 | 8/1990 | Smith | 190/107 X |
| 5,119,519 | 6/1992 | Foreman | 190/1 X |
| 5,131,513 | 7/1992 | Gossage | 190/107 |
| 5,160,001 | 11/1992 | Marceau | 190/111 X |
| 5,186,290 | 2/1993 | Takayama | 190/110 X |

FOREIGN PATENT DOCUMENTS

| | | | |
|---|---|---|---|
| 946333 | 4/1974 | Canada | 190/111 |
| 382145 | 1/1908 | France | 190/103 |
| 1146391 | 11/1957 | France | 190/107 |
| 5130910 | 5/1993 | Japan | 383/4 |
| 2018580 | 10/1979 | United Kingdom | 190/103 |

*Primary Examiner*—Sue A. Weaver
*Attorney, Agent, or Firm*—David A. Lingbeck

[57] ABSTRACT

This invention relates to a flexible garment and accessory case having a detachable briefcase having a main panel member preferably made of nylon and having a plurality of snap fasteners disposed on the front side thereof for detachably fastening three closeable pouch members thereupon for storing personal belongings such as toiletry products and the like. The flexible garment and accessory case having a detachable briefcase further has a second panel member which is removeably fastened about the main panel member and which is foldable onto itself to form a separate briefcase having separate compartments for storing documents as such and having a pocket ideal for carrying writing utensils as such.

3 Claims, 7 Drawing Sheets

FLEXIBLE GARMENT AND ACCESSORY CASE HAVING A DETACHABLE BRIEFCASE

BACKGROUND OF THE INVENTION

This invention relates to a flexible garment and accessory case having a detachable briefcase for carrying and storing clothing such as coats and the like and for carrying toiletry products in detachable closeable pouches and for documents and writing utensils and the like in a detachable briefcase.

Carrying cases of all types are well known in the art and are continually being changed and adapted to meet the changing needs of the users. Upon review of the prior art, none describes or suggests the flexible garment and accessory case having detachable briefcase of the present invention.

One known prior art is a COMPUTER CARRYING CASE, U.S. Pat. No. 5,160,001, which comprises a combination briefcase and carrying case for transporting a portable computer along with ancillary supplies, which includes a structure for suspending the computer unit in the central zone of the carrying case to protect the computer from being damaged.

Another known prior art is a CARRYING CASE WITH A HINGED LID AND CLOSURE MEMBER, U.S. Pat. No. 4,694,940, which comprises a tray located under the lid of the case, which overlies the compartment in the body of the case and which can be used as a writing tablet and which can be raised to permit access to the compartment.

Also, another known prior art is a COMBINATION ATTACHE CASE AND TRAVELING DESK, U.S. Pat. No 4,483,427, which comprises a working desk top compartment, which is separate from the central storage compartment, and further includes a hingedly connected box-like hollow base and lid members and further includes means for being maintained in a vertical position during use of the desk top compartment and means for retaining documents on the inner surface thereof.

Further, another known prior art is a DOCUMENT CARRIER, U.S. Pat. No. 5,131,513, which comprises a flexible waterproof material which is held in a rolled position by a fastener and which can be folded into an integral pocket when empty for easy storage thereof.

Yet, another Known prior art is a BRIEF BAG, U.S. Pat. No. 1,665,878, which comprises an apparel case inseparably united with the brief bag to form a unitary article with each having a closure affording access to the respective part and having straps extending through the apparel case and around the brief bag whereby articles in the apparel case may be stabilized.

None of the prior art provides the user with an all-in-one flexible garment and accessory case which has detachable portions such as a brief case for carrying papers as such and a plurality of detachable closeable pouches for carrying toiletries and the like.

SUMMARY OF THE INVENTION

This invention relates to an all-in-one flexible garment and accessory case having a detachable brief case comprising a flexible main panel member having a top edge, a first and second side edges, and a bottom edge with a first fastener means fixedly attached along the bottom edge thereof and a second fastener means fixedly attached along the top edge thereof with the side edges each having a foldable flap members integrally extending therefrom. The flexible main panel member has a plurality of snap fastener members fixedly attached and disposed upon one side thereof with a plurality of removeable, closeable pouch members having snap fastener means fixedly attached at the corners on one side of each of the pouch members, which mate to the snap fastener members on the main panel member. A second panel member having a first closure fastener means along a top edge thereof and a second closure fastener means along a bottom edge thereof is detachably attached along the bottom and top edges to the main panel. The second panel member can be folded into a briefcase with a compartment divider attached to one side of the second panel member to form two compartments inside the briefcase and with a pocket member fixedly attached to one side of the compartment divider to contain writing utensils and the like.

It is an objective of this invention to provide a flexible garment and accessory case having a detachable briefcase which has an all-in-one garment bag, removeable and closeable pouch members for carrying toiletry products as such, and a briefcase detachable from the garment and accessory case.

Another object of this invention is to provide a flexible garment and accessory case having a detachable briefcase which allows the user to conveniently carry all his/her personal belongings in only one case or bag rather than having to divide his/her belongings in a plurality of cases or bags.

Further, another object of this invention is to provide a flexible garment and accessory case having a detachable briefcase which is lightweight and can be easily carried by any user.

Yet, another object of this invention is to provide a flexible garment and accessory case having a detachable briefcase which allows a user to pack and carry all his/her personal belongings in only one bag or case which virtually eliminates any possibility of the user forgetting or losing his/her personal belongings since the user is apt to keep track of one bag or case better than having to keep track of a plurality of bags or cases especially if the user is traveling on airplanes.

Further objects and advantages of the present invention will become more apparent as the description proceeds and when taken in conjunction with the accompanying drawings wherein:

DETAILED DESCRIPTION OF THE INVENTION

Figure 1:
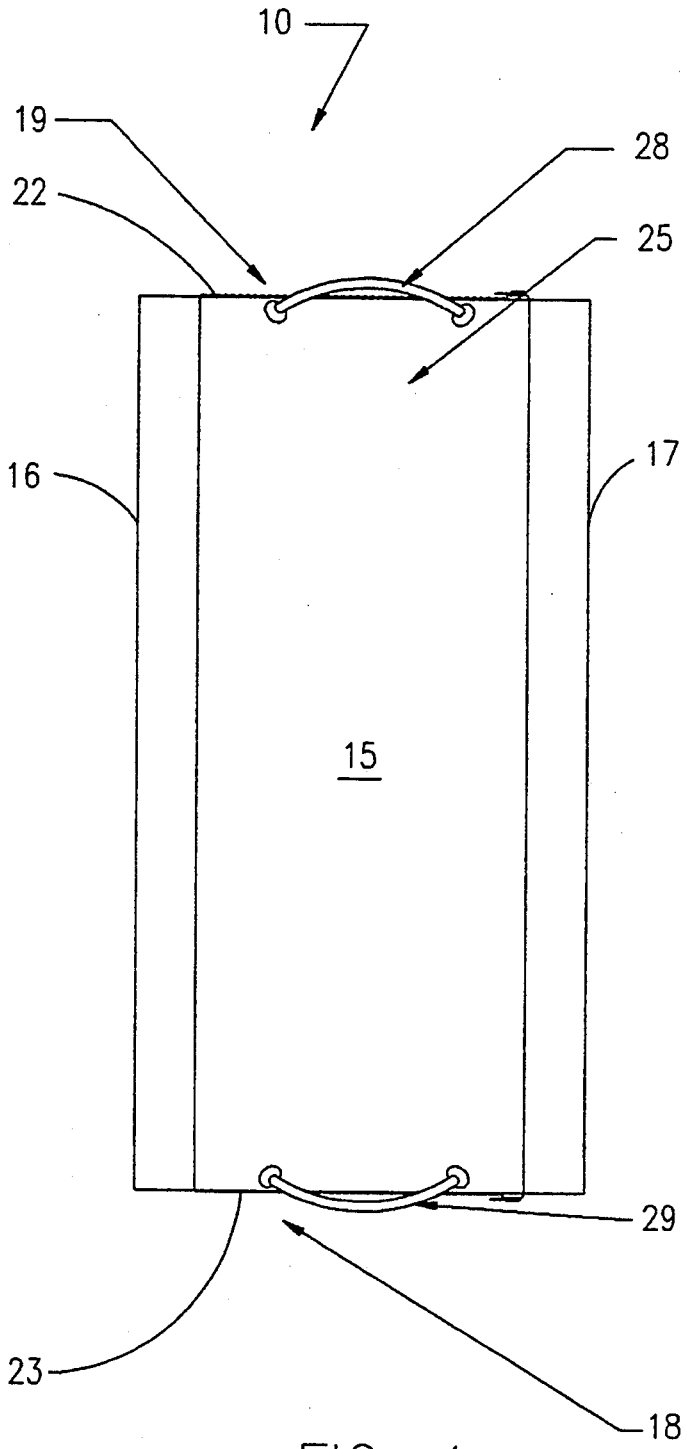
FIG. 1 is a front elevational view of the flexible garment and accessory case having a detachable briefcase vertically disposed and unfolded but closed.

Referring to the drawings in FIGS. 1 through 7, the flexible garment and accessory case having a detachable briefcase 10 is illustrated as having a main panel member 15 preferably made of nylon and having a top edge 19, a bottom edge 18 and two side edges 16 & 17 and further having a front side 24 and a back side 25. Two flap members 20 & 21 also preferably made of nylon are integrally attached one to each side edge 16 & 17 of the main panel member 15. A first fastener means 22 such as a zipper is fixedly attached or sewed along the top edge 19 of the main panel member 15. A second fastener means 23 such as a zipper or the like is fixedly attached or sewed along the bottom edge 18 of the main panel member 15. A flexible hold member 27 is fixedly attached near the top edge 19 of the main panel member 15 on the front side 24 thereof for hanging clothes (not shown) therefrom. Two strip-like fastener means 30 & 31 such as VELCRO or the like are fixedly attached or sewed one to each flap member 20 & 21 and extend along the length on the front sides of the flap members 20 & 21. A pair of strap members 28 & 29 preferably made of nylon are fixedly attached or sewed one near the top edge 19 of the main panel member 15 and one near the bottom edge 18 of the main panel member 15 on the back side 25 thereof used for conveniently carrying the flexible garment and accessory case 10. Four connector members (not shown), two being disposed near the top edge 19 of the main panel member 15 and two being opposedly disposed near the bottom edge 18 of the main panel member 15 on the front side 24 thereof, fasten the main panel member 15 onto itself for convenience in carrying the flexible garment and accessory case 10.

Figure 3:
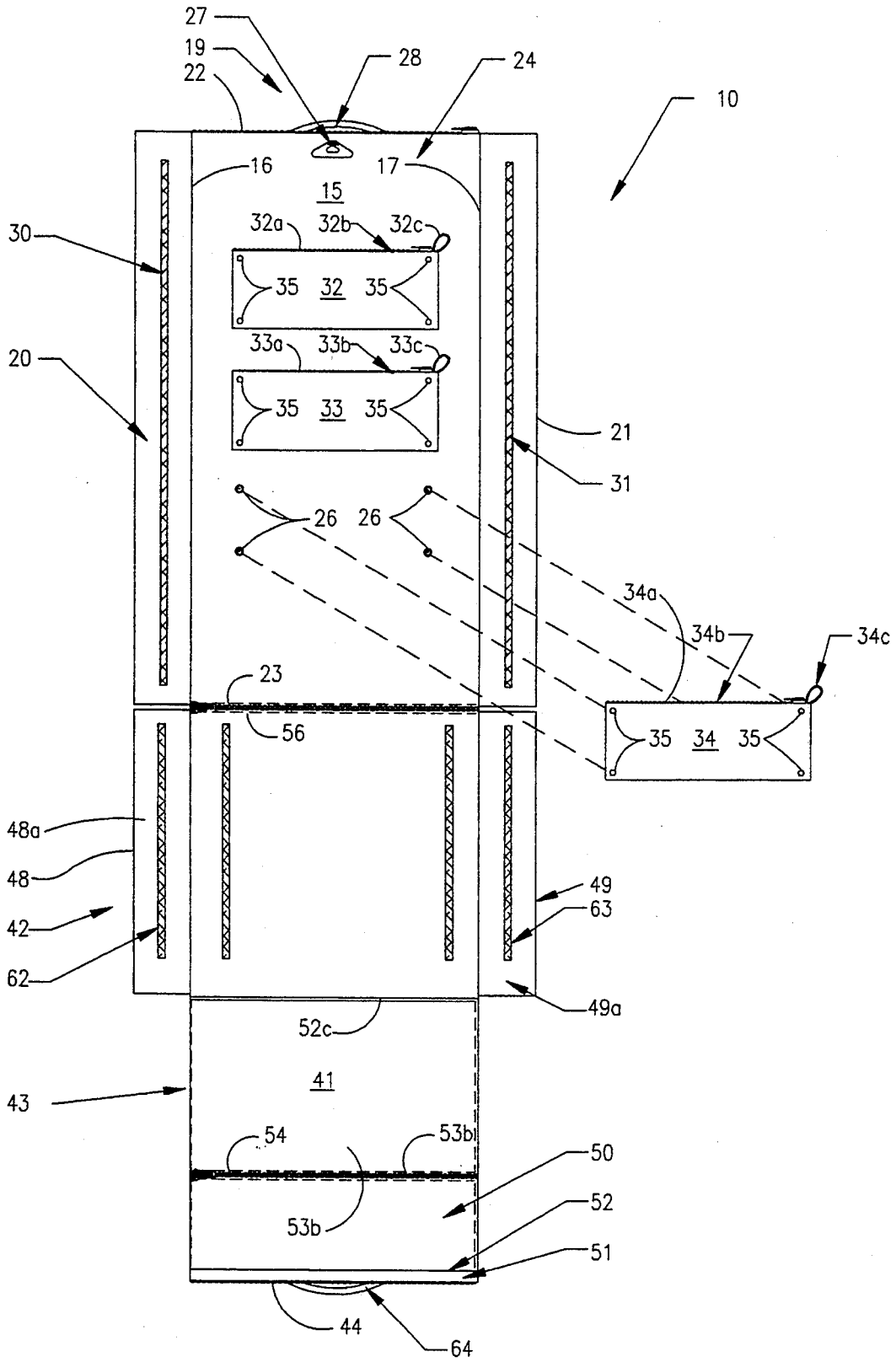
FIG. 3 is a front elevational view of the flexible garment and accessory case having a detachable briefcase showing the second panel member extending downward from the main panel member exposing the closeable, detachable pouch members.

As shown in FIG. 3, three removeable, closeable pouch members 32, 33, & 34 each being substantially rectangular in shape and each having four snap fastener means 35 disposed upon and fixedly attached on one side and near the corners thereof and arranged thereon to fasten to a plurality of snap fastener members 26 fixedly attached and spaced and disposed upon the front side 24 of the main panel member 15. The three removable closeable pouch members 32, 33, & 34 each have closure means 32*a*, 33*a*, & 34*a* such as zippers or VELCRO fixedly attached along or near the top edges 32*b*, 33*b*, & 34*b* thereof to close the pouch members 32, 33, & 34 which conveniently store personal belongings of the user such as toiletry products as such or other objects, and each further have a fastener strip (not shown) such as VELCRO fixedly attached along the bottom thereof for attaching to a like fastener strip (not shown) fixedly attached or sewed to the front side 24 of the main panel member 15 to allow storage of items between the pouch member 32, 33, & 34 and the main panel member 15. As shown in FIG. 3, the pouch members 33, & 34 are capable of being removed and detached from the front side 24 of the main panel member 15 and used separately or independently of the flexible garment and accessory case 10. Each of the pouch members 32, 33, & 34 have loop members 32*c*, 33*c*, & 34*c* carried by the closure means 32*a*, 33*a*, & 34*a* to facilitate carrying the pouch members 32, 33, & 34 separate from the flexible garment and accessory case 10.

Figure 2:
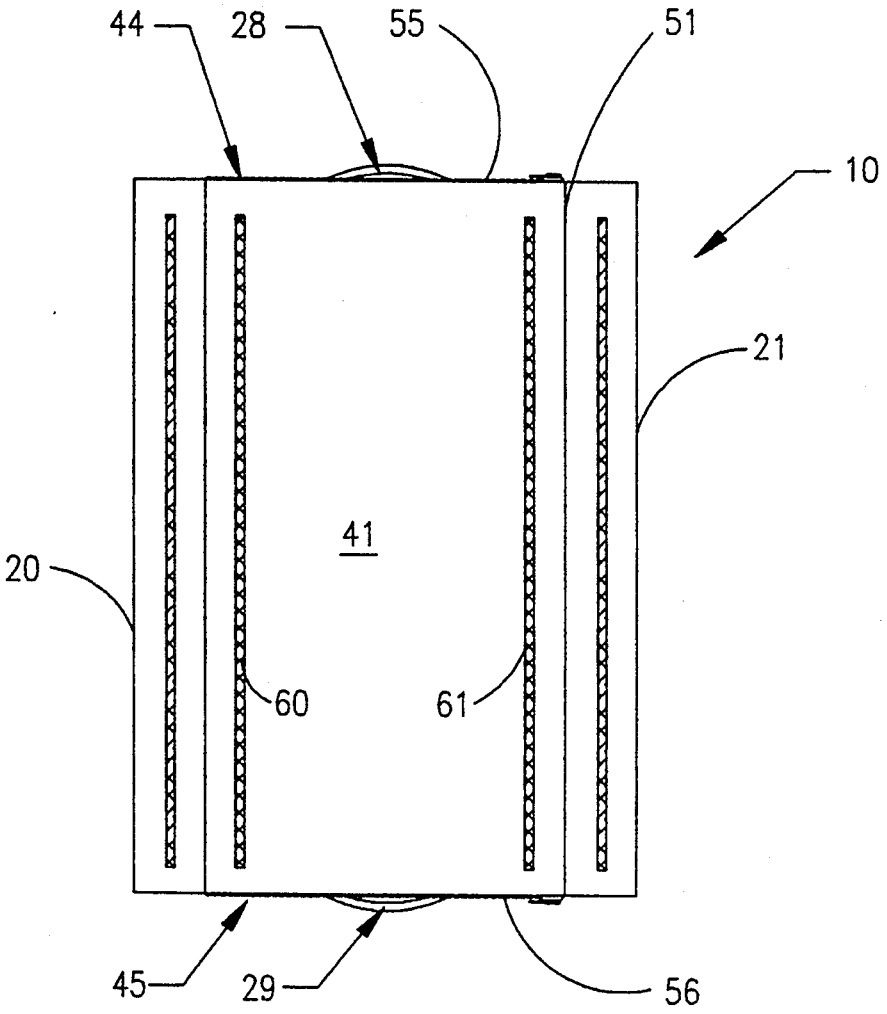
FIG. 2 is a front elevational view of the flexible garment and accessory case having a detachable briefcase with the flap members of the main panel member unfolded from about the side edges of the second panel member.
Figure 5:
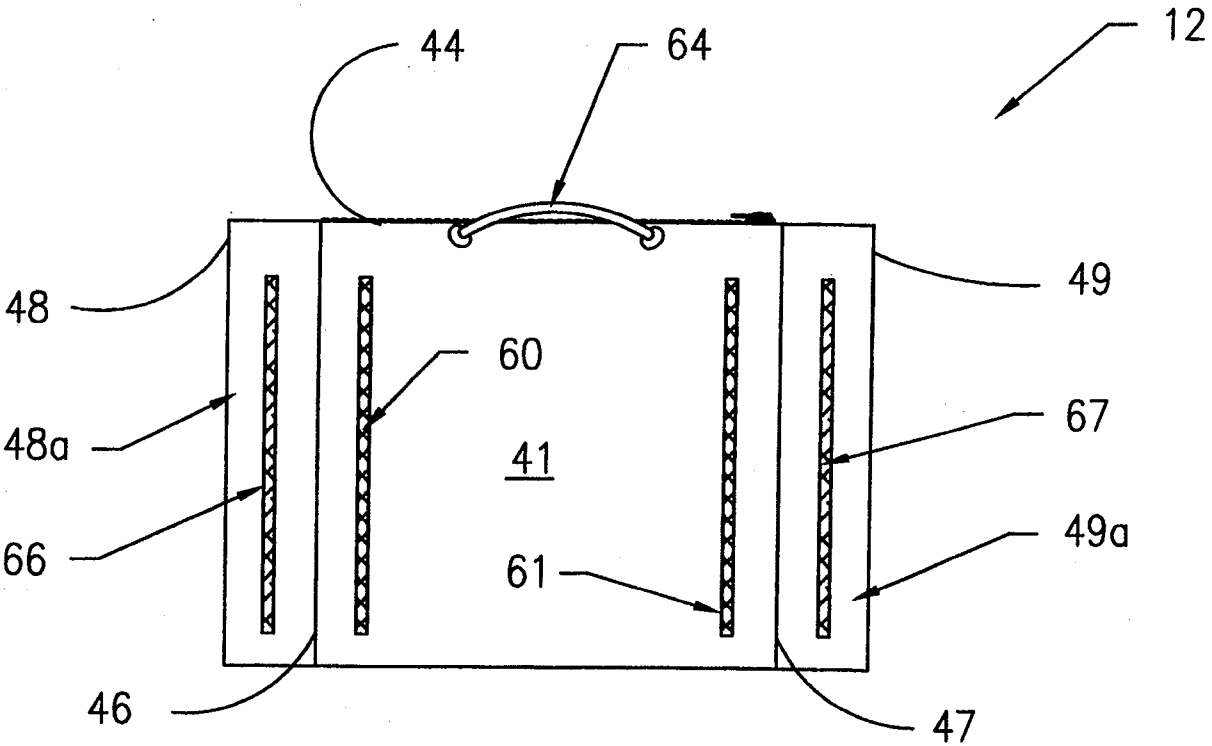
FIG. 5 is a front elevational view of the detachable briefcase removed from the flexible garment and accessory case and folded with the flap members on the lower portion of the briefcase being unfolded over the upper portion of the briefcase.
Figure 6:
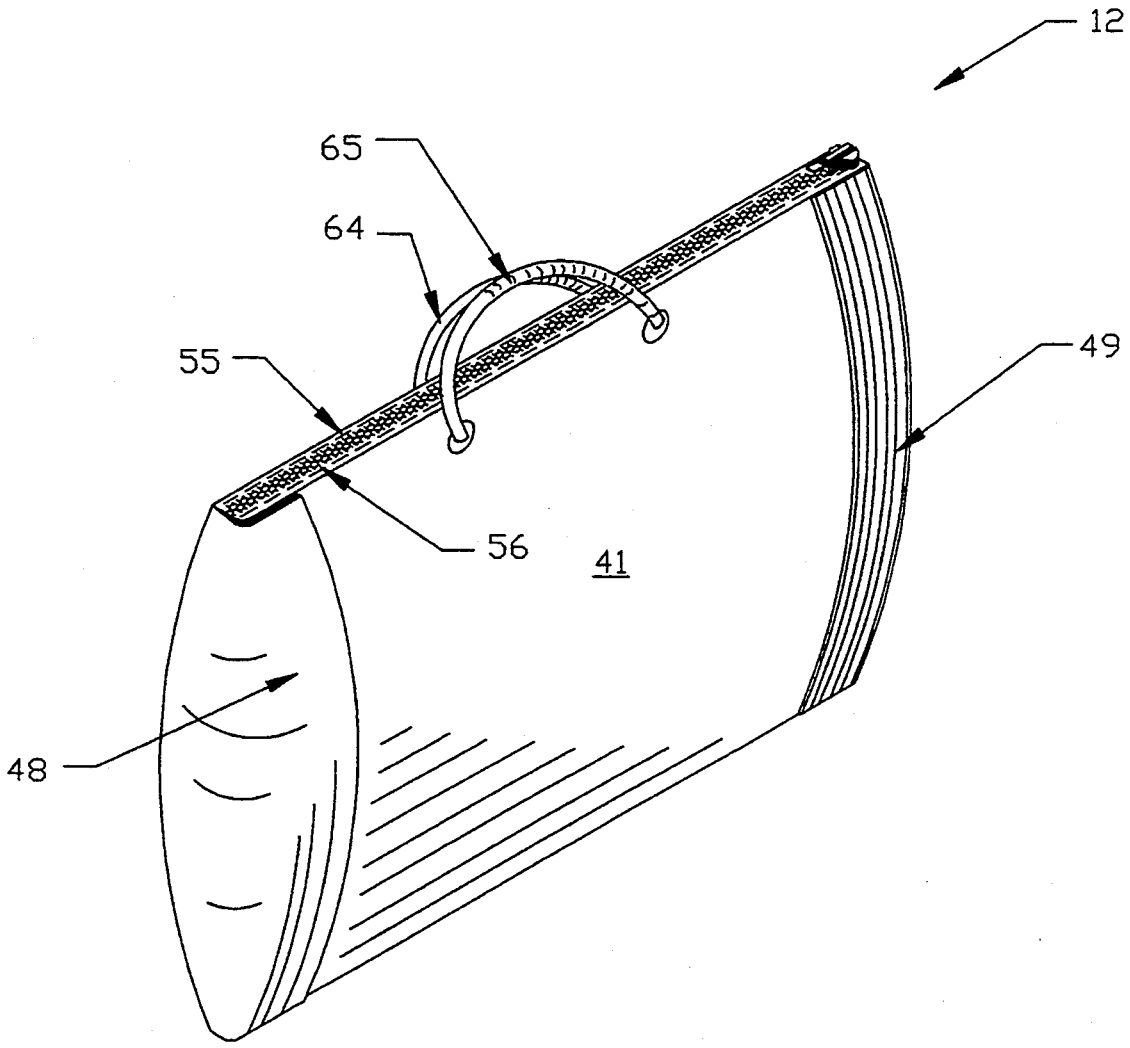
FIG. 6 is a perspective view of the detachable briefcase removed from the garment and accessory case.
Figure 7:
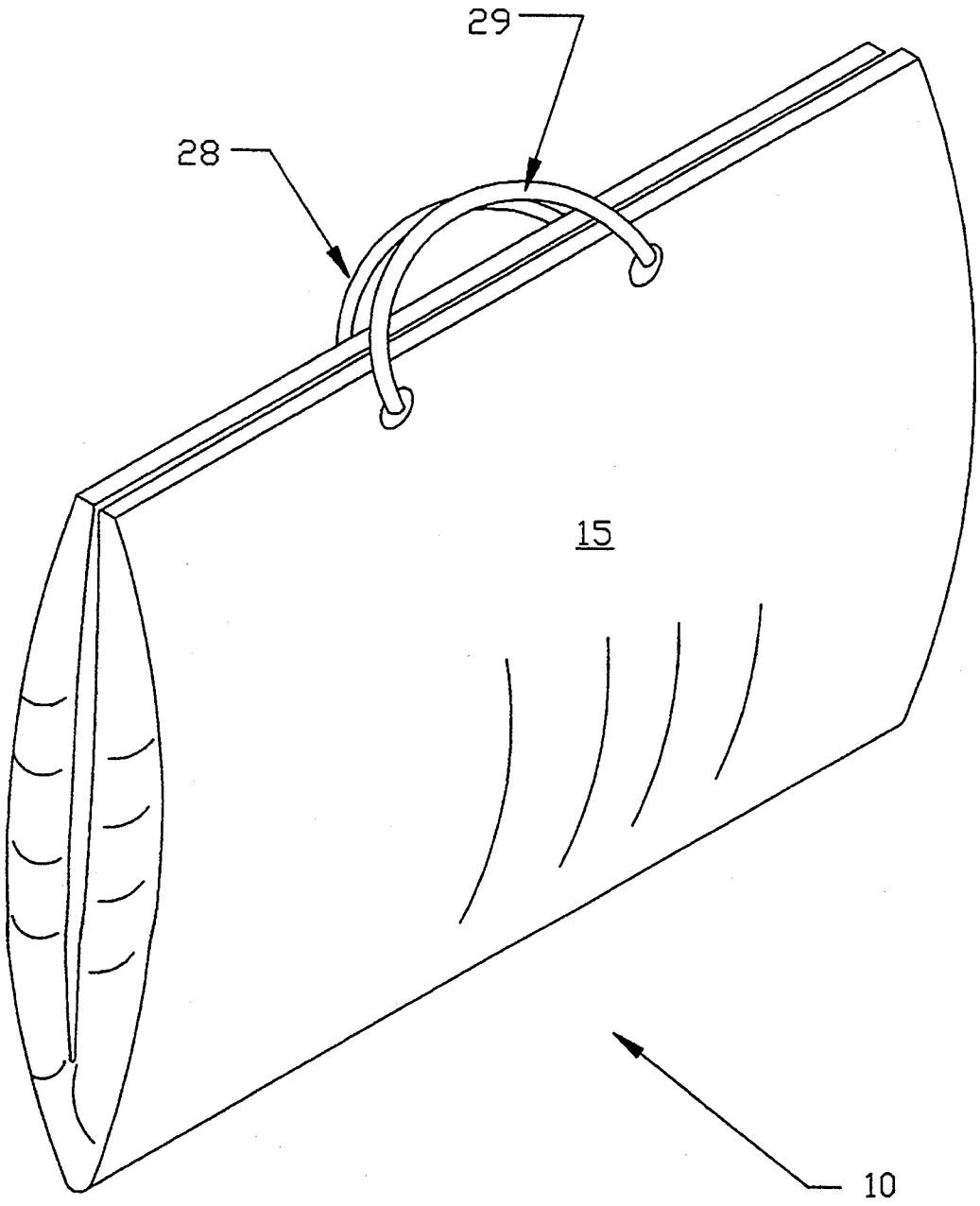
FIG. 7 is a perspective view of the flexible garment and accessory case in a folded ready to tote state.

As shown in FIG. 2, an elongate second panel member 41 preferably made of nylon and similarly dimensioned to the main panel member 15 comprises a top edge 44, a bottom edge 45, and two side edges 46 & 47 and further has a first closure, fastener means 55 such as a zipper fixedly attached or sewed along the top edge 44 thereof and a second closure, fastener means 56 such as a zipper fixedly attached or sewed along the bottom edge 45 thereof. The elongate second panel member 41 has an lower portion 42 and a upper portion 43 and has an inner side 50 and an outer side 51. The elongate second panel member 41 is detachably or removeably connected along the top 44 and bottom 45 edges thereof to the top 19 and bottom 18 edges of the main panel member 15 with the first and second fastener means 22 & 23 of the main panel member 15 and with the first and second closure fastener means 55 and 56 of the second panel member 41. Two flap members 48 & 49 are integrally attached one to each side edge 46 & 47 of the lower portion 42 of the second panel member 41 and extend outwardly from the side edges 46 & 47 of the second panel member 41 and are foldable and fastenable about the outer side of the second panel member 41 and about the upper portion 43 thereof to form the briefcase 12 as shown in FIGS. 4, 5, and 6.

Figure 4:
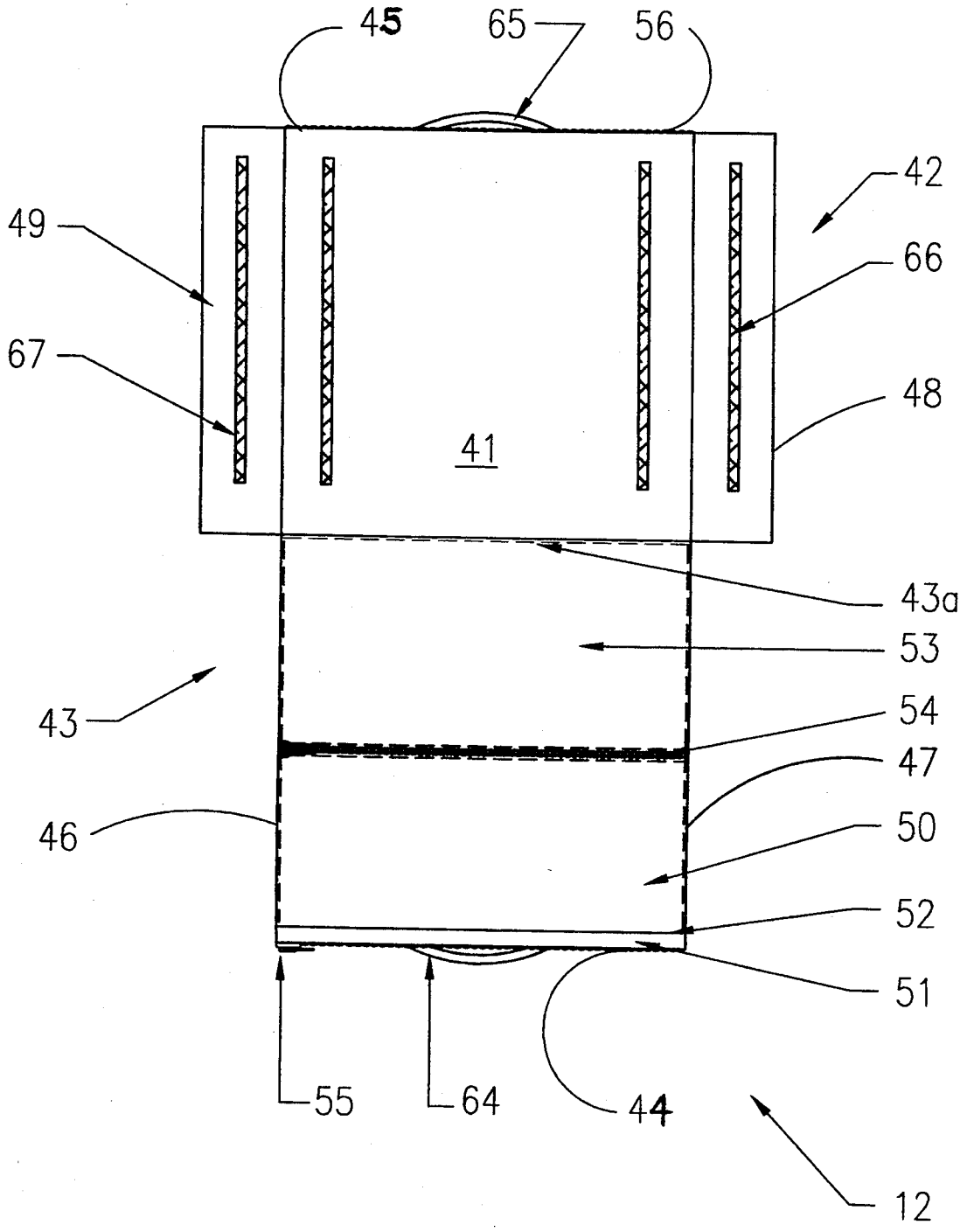
FIG. 4 is a front elevational view of the detachable briefcase removed from the flexible garment and accessory case and unfolded showing the inside compartments of the briefcase.

As shown in FIGS. 3 and 4, a compartment divider 52 is fixedly attached or sewed along the side edges and bottom edge 52*c* thereof to the inner side 50 of the upper portion 43 of the second panel member 41 near the side edges 46 & 47 of the upper portion 43 and along the bottom 43*a* of the upper portion 43, which is continuously connected to the lower portion 42. A pocket member 53 having a closure means 54 such as a zipper or the like, which is fixedly attached along the edge 53*b* at the open end 53*a* thereof, is fixedly attached or sewed to the compartment divider 52 near the bottom edge 52*c* thereof for storing essentially writing utensils as such. Two strip-like fastener means 62 & 63 such as VELCRO as such are fixedly attached or sewed along the length of the inner side 48*a* & 49*a* of the two flap members 48 & 49. Two elongate fastener means 60 & 61 such as VELCRO as such are fixedly attached or sewed near the side edges 46 & 47 on the outer side 51 of the second panel member 41 along the length thereof. Two strip-like closure means 66 & 67 are fixedly attached or sewed one near the top edge 44 and one near the bottom edge 45 of the second panel member 41 on the inner side 50 thereof to close the briefcase 12 as shown in FIG. 6. Two handle members 64 & 65 are fixedly attached or sewed one near the top edge 44 and one near the bottom edge 45 of the second panel member 41 on the outer side 51 thereof so that the user can conveniently carry the briefcase 12.

To prepare the flexible garment and accessory case 10 for use such as carrying clothes and the like, the user preferably lays out the flexible garment and accessory case 10 on a generally horizontal surface with the main panel member 15 to the bottom and the second panel member 41 to the top and unfastens the first fastener means 22 along the top edge 19 of the main panel member 15 from the first closure fastener means 55 along the top edge 44 of the second panel member 41 and unfastens he strip-like fastener members 30 & 31 on the flap members 20 & 21 on the main panel member 15 from about the elongate fastener members along the length of the outer side 51 of the second panel member 41 and unfolds the two flap members 48 & 49 outward from the second panel member 41 to remove and unfold the second panel member 41 about the bottom edge of the main panel member to expose the front side 24 of the main panel member 15 and the plurality of pouch members 32, 33, & 34 detachably fastened to the front side 24 of the main panel member 15, which are detachably disposed laterally along the length of the main panel member 15. The pouch members 32, 33, & 34 can be easily detached and removed from the front side 24 of the main panel member 15 and used to store any personal items of the user such as toiletry products as such as desired by the user and can be reattached to the front side 24 of the main panel member 15. The user can lay clothes such as coats and the like over the main panel member 15 and can hook the clothes to the hold member 27 near the top edge 19 thereof.

To close the flexible garment and accessory case 10, the user preferably folds the second panel member 41 about the bottom edge of 18 and over the main panel member 15 which is detachably fastened to the bottom edge 45 of the second panel member 41, and fastens the first fastener means 22 of the main panel member 15 to the first closure fastener means 55 of the second panel member 41, and folds both flap members 20 & 21 on the main panel member 15 about the outer side 51 of the second panel member 41 to fasten the strip-like fastener means 30 & 31 on the flap members 20 & 21 to the elongate fastener means 60 & 61 on the outer side 51 of the second panel member 41. As shown in FIG, 7, to conveniently carry the flexible garment and accessory case 10, the user can fold the closed flexible garment and accessory case 10 onto itself with the second panel member 41 being folded to the inside, and can carry the flexible garment and accessory case 10 using the two flexible strap members 28 & 29 fixedly attached to the back side 25 of the main panel member 15.

To detach the briefcase 12 from the flexible garment and accessory case 10, the user preferably lays out the flexible garment and accessory case 10 on a generally horizontal surface with the main panel member 15 to the bottom and the second panel member 41 to the top and unfastens the first fastener means 22 from the first closure fastener means 55 and unfastens the second fastener means 23 along the bottom edge 18 of the main panel member 15 from the second closure fastener means 56 along the bottom edge 45 of the second panel member 41 to remove the second panel member 41 from the main panel member 15. The user then preferably unfolds the two flap members 48 & 49 on the lower portion 42 of the second panel member 41 outward and then detachably fastens the first closure fastener means 55 to the second closure fastener means 56 and then folds the upper portion 43 over the lower portion 42 and then folds the two flap members 48 & 49 of the second panel member 41 over the outer side 51 of the upper portion 43 and detachably fastens the two strip-like fastener members 62 & 63 on the two flap members 48 & 49 to the elongate fastener members 60 & 61 on the outer side 51 of the second panel member 41 to form the briefcase 12 which can be opened to two inside compartments 70 & 71 which are separated by the compartment divider 52. The briefcase 12 has two handle members 64 & 65 fixedly attached on the outer side 51 of the second panel member 41 to allow the user to conveniently carry the briefcase 12.

Once the user is finished using the briefcase 12 and is ready to pack the flexible garment and accessory case 10, the user can easily refasten the second panel member 41 to the main panel member 15 to form the flexible garment and accessory case 10. The user preferably unfastens the two strip-like fastener means 62 & 63 on the flap members 48 & 49 of the second panel member 41 from the two elongate fastener means 60 & 61 along the length of the outer side 51 of the second panel member 41 and unfastens the first closure fastener means 55 from the second closure fastener means 56 and unfolds the flap members 48 & 49 on the second panel member 41 outward to allow the upper portion 43 to be unfolded from about the lower portion 42 of the second panel member 41 which can be laid open over the main panel member 15 with the inner side 50 of the second panel member 41 preferably facing the front side 24 of the main panel member 15. To form the flexible garment and accessory case 10, the user preferably folds the two flap members 48 & 49 on the second panel member 41 about the inner side 50 thereof and fastens the second closure fastener means 56 on the second panel member 41 to the second fastener means 23 on the main panel member 15 and further fastens the first closure fastener means 55 on the second panel member 41 to the first fastener means 22 on the main panel member 15 and further folds the two flap members 20 & 21 on the main panel member 15 about the outer side 51 of the second panel member 41 and detachably fastens the strip-like fastener means 30 & 31 fixedly attached on the two flap members 20 & 21 of the main panel member 15 to the two elongate fastener means 60 & 61 fixedly attached to the outer side 51 of the second panel member 41 which can be folded to the inside so the user can conveniently carry the flexible garment and accessory case 10 with the two handle members 64 & 65.

Various changes and departures may be made to the invention without departing from the spirit and scope thereof. Accordingly, it is not intended that the invention be limited to that specifically described in the specification or as illustrated in the drawing but only as set forth in the claims.

What is claimed is:

1. A flexible garment and accessory case having a detachable briefcase comprising:

a main panel member having a top edge, bottom edge, and two side edges and having a front side and a back side, said main panel member further having a plurality of snap fastener members fixedly attached and disposed upon said front side thereof and having a pair of flap members integrally attached to said side edges thereof;

a second panel member having a top edge, bottom edge, and two side edges and having an inner side and an outer side, said second panel member further having an upper portion and a lower portion; means for detachably attaching said top and said bottom edges of said second panel member to said top and said bottom edges of said main panel member for forming said garment and accessory case, said second panel member further being detachable from said main panel member and including means for forming said second panel member into said briefcase, said brief case forming means including elongate fastener means fixedly attached upon said outer side near said side edges of said second panel member, said flap members of said main panel member being foldable upon said outer side of said second panel member and each having a strip-like fastener means fixedly attached to one side thereof said strip-like fastener means being detachably fastened to said elongate fastener means on said second panel member to form said garment and accessory case for storing and carrying clothes as such; and a plurality of pouch members each having at least one compartment and means for closing said compartment for storing personal belongings of a user, said pouch members further having a plurality of snap fastener means fixedly attached thereto, said snap fastener means being detachably fastened to said snap fastener members on said main panel member, said pouch members each capable of being detached and used separately from said main panel member.

2. A flexible garment and accessory case having a detachable briefcase comprising:

a main panel member having a top edge, bottom edge, and two side edges and having a front side and a back side, said main panel member further having a plurality of snap fastener members fixedly attached and disposed upon said front side thereof; a second panel member having a top edge, bottom edge, and two side edges and having an inner side and an outer side, said second panel member further having an upper portion and a lower portion; means for detachably attaching said top and said bottom edges of said second panel member to said top and said bottom edges of said main panel member for forming said garment and accessory case, said second panel member further being detachable from said main panel member and adaptable to form said briefcase, also said second panel member having elongate fastener means fixedly attached upon said outer side near said side edges of said second panel member and has having two flap members integrally connected to said side edges of said lower portion thereof, said flap members being foldable upon said upper portion and each having a fastener means fixedly attached on one side thereof, said fastener means being detachably fastenable to said elongate fastener means on said outer side of said second panel member to form said briefcase when said second panel member is detached from said main panel member; and a plurality of pouch members each having at least one compartment and means for closing said compartment for storing personal belongings of a user, said pouch members further having a plurality of snap fastener means fixedly attached thereto, said snap fastener means being detachably fastened to said snap fastener members on said main panel member, said pouch members each capable of being detached and used separately from said main panel member.

3. A flexible garment and accessory case having a detachable briefcase comprising:

a main panel member having a top edge, bottom edge, and two side edges and having a front side and a back side, said main panel member further having a plurality of snap fastener members fixedly attached and disposed upon said front side thereof; a second panel member having a top edge, bottom edge, and two side edges and having an inner side and an outer side, said second panel member further having an upper portion and a lower portion; means for detachably attaching said top and said bottom edges of said second panel member to said top and said bottom edges of said main panel member for forming said garment and accessory case, said second panel member further being detachable from said main panel member and adaptable to form said briefcase, also said second panel member having elongate fastener means fixedly attached upon said outer side near said side edges of said second panel member and having two flap members integrally connected to said side edges of said lower portion thereof, said flap members being foldable upon said upper portion and each having a fastener means fixedly attached on one side thereof, said fastener means being detachably fastenable to said elongate fastener means on said outer side of said second panel member to form said briefcase when said second panel member is detached from said main panel member, said second panel member having a compartment divider fixedly attached to said-inner side to form separate compartments when said second panel member is detached from said main panel member and adapted to form said briefcase, said compartment divider having a pocket member with means for closing said pocket member fixedly attached thereto for further storing objects within said briefcase; and a plurality of pouch members each having at least one compartment and means for closing said compartment for storing personal belongings of a user, said pouch members further having a plurality of snap fastener means fixedly attached thereto, said snap fastener means being detachably fastened to said snap fastener members on said main panel member, said pouch members each capable of being detached and used separately from said main panel member.

* * * * *